US007299998B2

(12) United States Patent
Ricco et al.

(10) Patent No.: US 7,299,998 B2
(45) **Date of Patent: *Nov. 27, 2007**

(54) INTERNAL COMBUSTION ENGINE FUEL INJECTOR

(75) Inventors: Mario Ricco, Valenzano (IT); Sisto Luigi De Matthaeis, Valenzano (IT); Adriano Gorgoglione, Valenzano (IT); Alfonso Di Meo, Valenzano (IT); Sergio Stucchi, Valenzano (IT)

(73) Assignee: C.R.F. Societa Consortile per Azioni (IT)

( * ) Notice: Subject to any disclaimer, the term of this patent is extended or adjusted under 35 U.S.C. 154(b) by 0 days.

This patent is subject to a terminal disclaimer.

(21) Appl. No.: 11/171,658

(22) Filed: Jun. 30, 2005

(65) Prior Publication Data

US 2006/0032950 A1 Feb. 16, 2006

(30) Foreign Application Priority Data

Jun. 30, 2004 (EP) ..... 04425475
May 27, 2005 (EP) ..... 05425383

(51) Int. Cl.
*F02M 41/16* (2006.01)

(52) U.S. Cl. ..... 239/96; 239/585.1; 239/585.4; 251/129.16

(58) Field of Classification Search ..... 239/533.2–533.12, 585.1–585.3, 88, 900, 239/96, 585.4; 251/129.15, 129.16, 129.17, 251/129.19; 123/466–468
See application file for complete search history.

(56) References Cited

U.S. PATENT DOCUMENTS 5,088,647 A * 2/1992 Yoshida et al. ..... 239/96
5,947,380 A 9/1999 Coldren et al.
6,085,719 A * 7/2000 Heinz et al. ..... 123/300

(Continued)

FOREIGN PATENT DOCUMENTS

DE 38 02 648 8/1989

(Continued)

OTHER PUBLICATIONS

Search Report issued by European Patent Office on Oct. 27, 2004 in connection with corresponding European application No. EP 04 42 5475.

(Continued)

*Primary Examiner*—Steven J. Ganey
(74) *Attorney, Agent, or Firm*—Ostrolenk, Faber, Gerb & Soffen, LLP

(57) ABSTRACT

An internal combustion engine fuel injector (1) has a rod (10) movable along an axis (3) to open/close a nozzle, and a servovalve (7) having a control chamber (23) with a discharge passage (26) which is opened/closed by a shutter (17) movable axially under the control of an electro-actuator (14); the servovalve (7) also has a fixed axial rod (33) having an outer lateral surface (34) through which the discharge passage (26) comes out; the shutter (17) is fitted to the axial rod (33) to slide axially in substantially fluidtight manner, and, when closing the discharge passage (26), is subjected to substantially zero resultant axial pressure by the fuel; and the control chamber (23) is bounded radially by a tubular portion (8) formed in one piece with said axial rod (33).

14 Claims, 1 Drawing Sheet

U.S. PATENT DOCUMENTS

| | | | | |
|---|---|---|---|---|
| 6,113,000 | A * | 9/2000 | Tian | 239/88 |
| 6,257,499 | B1 | 7/2001 | Sturman | |
| 6,293,254 | B1 * | 9/2001 | Crofts et al. | 123/467 |
| 6,565,013 | B1 * | 5/2003 | Buergler et al. | 239/95 |
| 6,705,291 | B2 * | 3/2004 | Rueger et al. | 123/467 |
| 6,837,221 | B2 * | 1/2005 | Crofts et al. | 123/467 |

FOREIGN PATENT DOCUMENTS

| | | | |
|---|---|---|---|
| DE | 43 10 984 | | 4/1993 |
| DE | 4310984 | A1 * | 10/1994 |
| DE | 197 40 997 | | 3/1999 |
| EP | 0 262 539 | | 9/1987 |
| EP | 0 740 068 | | 4/1996 |
| EP | 0740068 | A2 * | 10/1996 |
| WO | WO 01/11227 | | 2/2001 |

OTHER PUBLICATIONS

Search Report issued by European Patent Office on Aug. 19, 2005 in connection with corresponding European application No. EP 05 42 5383.

* cited by examiner

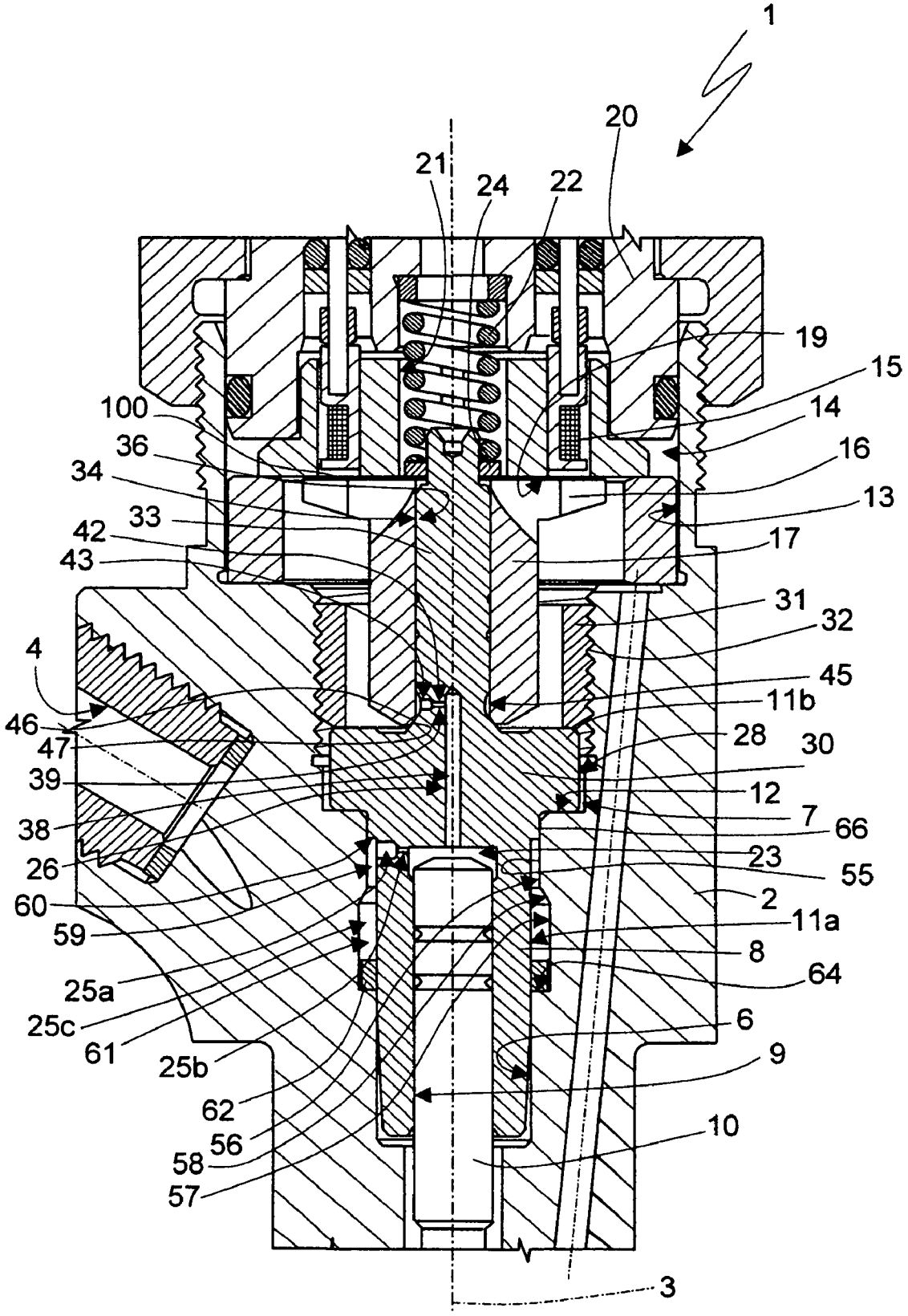
1
20
21
24
22
19
15
14
16
13
17
100
36
34
33
42
43
31
32
4
45
11b
46
47
28
30
39
12
7
66
38
23
55
26
2
60
11a
59
8
64
25a
25c
6
61
25b
9
62
10
56
58
57
3

INTERNAL COMBUSTION ENGINE FUEL INJECTOR

The present invention relates to an internal combustion engine fuel injector.

As is known, an injector comprises an injector body, which defines a nozzle for injecting fuel into the engine, and houses a control rod movable along an axis to activate a pin closing the nozzle. The injector body also houses an electric control servovalve comprising a control chamber bounded axially at one side by the control rod and at the other side by an end wall having an outlet hole, which is opened/closed by a shutter to communicate with a discharge conduit and so vary the pressure in the control chamber. More specifically, the cross section of the outlet hole is calibrated to accurately set fuel flow from the control chamber to the discharge conduit, and the shutter is movable axially under the control of an electro-actuator and the axial thrust of a spring, which is preloaded to keep the outlet hole closed when the electro-actuator is idle.

A need is felt for injectors in which the shutter opening/closing the outlet hole of the control chamber is subjected to substantially zero pressure when the shutter is in the closed position, so as to reduce the preload of the spring, the force required of the electro-actuator, and therefore size, as compared with solutions in which the shutter closes the outlet hole axially. More specifically, in such injectors, in which the shutter is "balanced" in terms of axial pressure, even a small amount of lift of the shutter produces a large fuel flow section to the discharge conduit, thus improving dynamic performance of the injector, i.e. by eliminating so-called "bounce" of the shutter at the end of the opening and closing strokes.

At the same time, a need is also felt for an injector which, in addition to a "balanced" shutter, provides for minimizing potential variations in opening/closing performance of the injection nozzle with respect to design conditions, as a result of flow conditions and, in particular, the high pressure of the fuel in the injector.

It is an object of the present invention to provide an internal combustion engine fuel injector designed to meet the above demands in a straightforward, low-cost manner, and which, in particular, is of relatively straightforward, compact construction.

According to the present invention, there is provided a fuel injector for an internal combustion engine; the injector terminating with a nozzle for injecting fuel into a relative cylinder of the engine, and comprising:

a hollow injector body extending in an axial direction;

a control rod movable axially with respect to said injector body to open/close said nozzle;

a control servovalve housed in said injector body and comprising:

a) an electro-actuator;

b) a control chamber, which is bounded axially at one side by said control rod and radially by a tubular portion, communicates with a fuel inlet, and has a discharge passage comprising a calibrated portion;

c) an axial guide fixed with respect to said injector body, and having a lateral surface through which said discharge passage comes out; and d) a shutter fitted in substantially fluidtight manner to said lateral surface, so as to slide axially, under the control of said electro-actuator, between a closed position, in which it closes said discharge passage and is subjected to a substantially zero resultant axial force by the pressure of the fuel, and an open position, in which it opens said discharge passage to vary the pressure in said control chamber and so produce axial movement of said control rod;

characterized in that said tubular portion and said axial guide form part of a single body formed in one piece.

A preferred, non-limiting embodiment of the present invention will be described by way of example with reference to the accompanying drawing, which shows a cross section, with parts removed for clarity, of a preferred embodiment of an internal combustion engine fuel injector in accordance with the present invention.

Number 1 in the accompanying drawing indicates as a whole a fuel injector (shown partly) for an internal combustion engine, in particular a diesel engine (not shown).

Injector 1 comprises a hollow body or casing 2, normally referred to as an "injector body", extending along a longitudinal axis 3 and having a lateral inlet 4 connectable to a high-pressure, e.g. roughly 1800-bar, fuel feed conduit. Casing 2 terminates with a nozzle (not shown) communicating with inlet 4 and for injecting fuel into a relative engine cylinder.

Casing 2 defines an axial cavity 6 housing a metering servovalve 7 comprising a tubular portion or so-called "valve body" 8. Portion 8 defines an axial hole 9, in which a control rod 10 slides axially in fluidtight manner, and has a cylindrical outer surface 11*a* from which extends a locating projection 66 fitted to an inner surface 55 of body 2.

More specifically, rod 10 is movable axially inside hole 9 to control in known manner a shutter pin (not shown) for opening and closing the injection nozzle.

Casing 2 has another cavity 13 coaxial with cavity 6 and housing an actuator device 14, which comprises an electromagnet 15 for controlling a slotted-disk armature 16 terminating axially with a sleeve 17. More specifically, electromagnet 15 is defined by a magnetic core, has a stop surface 19 perpendicular to axis 3, and is held in position by a support 20.

Device 14 has an axial cavity 21 housing a helical compression spring 22 preloaded to exert thrust on armature 16 in the opposition direction to the attraction exerted by electromagnet 15. More specifically, one end of spring 22 rests against support 20, and the other end acts on armature 16 via a washer 24.

Servovalve 7 also comprises a control or metering chamber 23 bounded radially by portion 8 and communicating permanently with inlet 4—to receive pressurized fuel—via a channel 25*a* formed in portion 8 and having a calibrated portion 25*b*, via an annular chamber 25*c* bounded radially by surfaces 11*a* and 55, and via a passage (not shown) formed in body 2.

Here and hereinafter, "calibrated portion" or "calibrated hole" is intended to mean a hole of extremely precise cross section and length to produce a given pressure difference between the inlet and outlet of the hole.

Portion 8 defines the end portion of a body 28 formed in one piece and also comprising an intermediate axial portion 30, which defines the end of hole 9, i.e. defines chamber 23 axially at the opposite end to rod 10.

Portion 30 terminates with an outer flange 11*b*, which projects radially with respect to projection 66, rests axially directly on a shoulder 12 of cavity 6, and is gripped axially against shoulder 12, to ensure a fluidtight seal, by a threaded ring nut 31 screwed to an internal thread 32 of body 2.

Body 28 also comprises a rod 33, which is smaller in diameter than portion 30, projects from portion 30 along axis 3 towards cavity 21, and is bounded externally by a cylindrical lateral surface 34 for guiding axial slide of sleeve 17. More specifically, sleeve 17 has a cylindrical inner surface 36 fitted to lateral surface 34 in substantially fluidtight manner with an appropriate diametrical clearance, e.g. of less than 4 microns, or with the interposition of sealing members.

Chamber 23 also comprises a fuel outlet or discharge passage indicated as a whole by 26 and formed entirely inside body 28. Passage 26 comprises a first portion 38 formed along axis 3 partly in portion 30 and partly in rod 33; and a radial second portion 39 formed in rod 33 and which comes out through lateral surface 34. More specifically, portion 38 is defined by a cylindrical dead hole, while portion 39 comprises a calibrated portion 42 (in the sense explained above) which comes out inside portion 38; and an outlet portion 43 larger in cross section than, and connected to, portion 42.

In a variation not shown, a larger number of portions 39 may be provided, angularly spaced about axis 3.

Portion 43 comes out of rod 33 inside an annular chamber 45 formed in lateral surface 34, axially adjacent to portion 30, and which is opened/closed by axial slide of sleeve 17. Sleeve 17 functions as a shutter, and is movable between a forward limit position, in which it closes the outlet of passage 26 and rests axially, at an end 46, on a conical shoulder 47 of body 28 between portion 30 and rod 33, and a withdrawn limit position, in which armature 16 rests axially on surface 19 with the interposition of a plate 100 defining the residual air gap between armature 16 and electromagnet 15. In the withdrawn limit position, armature 16 connects chamber 45 to a discharge conduit of the injector (not shown) via an annular passage between ring nut 31 and sleeve 17, the slots in armature 16, cavity 21, and an opening in support 20.

In other words, when electromagnet 15 is energized, armature 16, and therefore shutter 17, is drawn towards electromagnet 15 to discharge fuel from chamber 23 and reduce the fuel pressure, and so produce axial movement of rod 10 to control the injection nozzle. Conversely, when electromagnet 15 is deenergized, spring 22 pushes armature 16, and therefore shutter 17, into the forward limit position.

In the forward limit position, since the pressure in chamber 45 only acts radially on surface 34, the fuel exerts substantially zero resultant axial thrust on sleeve 17.

As shown, inner surface 55 of body 2 comprises two cylindrical surfaces 56, 57 joined by a conical surface 58 converging axially towards surface 56 and projection 66.

Chamber 25*c* therefore comprises an annular gap 59 bounded externally by surface 56 and axially by an annular shoulder 60 defining projection 66; and an annular gap 61 bounded externally by surface 57 and housing a sealing ring 62 interposed between surfaces 11*a* and 55 and resting axially on an annular shoulder 64 of body 2.

Gap 59 is radially smaller than gap 61, so that, other geometrical and dimensional conditions being equal, the ideal fluid sealing circle between flange 11*b* and shoulder 12 is closer to axis 3 than if surface 56 were the same diameter as surface 57.

As a result, the area of body 28 on which the pressure of the fuel in chamber 25*c* acts axially is smaller, and the axial forces acting on body 28 towards armature 16 are therefore also reduced.

With reference to the accompanying drawing, portion 42 is formed in such a position as to produce swirl and/or cavitation in the fuel outflow close to the sealing area between end 46 of shutter 17 and shoulder 47 of body 28, i.e. immediately downstream from the outlet of passage 26. More specifically, portion 42 is formed close to the outlet of passage 26 to minimize, downstream from portion 42, relatively large fuel volumes which would otherwise produce laminar flow from passage 26. Portion 43 defines a relatively small volume downstream from portion 42, and therefore does not tend to produce laminar flow. What is more, being larger in cross section than portion 42, it assists in producing the cavitation effect at the outlet in chamber 45.

In the presence of swirl and/or cavitation as referred to above, the discharge coefficient through portion 42 and, therefore, fuel flow from passage 26 are unaffected by the ambient pressure conditions in which sleeve 17 moves, so that fuel flow from chamber 23 is prevented from varying with time and/or with respect to design as a function of conditions downstream. Variations in flow, in fact, are highly undesirable by producing variations in fuel discharge time from chamber 23 and, therefore, in the opening/closing time of the nozzle of injector 1 with respect to design conditions.

Variations in fuel discharge time and, therefore, in nozzle opening/closing time with respect to design conditions are also reduced by reducing static drift in the axial position of the various portions housed in body 2. That is, the high in-service pressures in chamber 25*c* normally tend to produce static drift in the axial position of portion 30 towards armature 16, thus reducing the maximum travel of armature 16 and sleeve 17, and so resulting in a variation in fuel flow from chamber 45 to the discharge conduit with respect to design, on account of the different opening and closing times of armature 16 and sleeve 17.

Firstly, static drift is reduced by the high degree of rigidity of portions 8, 30, 33 as a whole, which is achieved by portions 8, 30, 33 being formed in one piece to form body 28.

The absence of separate and/or additional bodies in the formation of body 28 and/or definition of chamber 23 also reduces the axial size of servovalve 7, and greatly simplifies production of injector 1 by eliminating complex finish machining and/or surface hardening, which would otherwise be necessary to achieve the required precision fits and machining tolerances.

Secondly, static drift is reduced by reducing the radial size of gap 59 with respect to that of gap 61, and so reducing axial pressure on body 28 towards armature 16, as explained in detail above.

Clearly, changes may be made to injector 1 as described and illustrated herein without, however, departing from the scope of the present invention as defined in the accompanying claims.

The invention claimed is:

1. A fuel injector for an internal combustion engine; the injector terminating with a nozzle for injecting fuel into a relative cylinder of the engine, and comprising:

a hollow injector body extending in an axial direction;

a control rod movable axially with respect to said injector body to open/close said nozzle;

a control servovalve housed in said injector body and comprising:

a) an electro-actuator;

b) a control chamber, which is bounded axially at one side by said control rod and radially by a tubular portion, communicates with a fuel inlet, and has a discharge passage comprising a calibrated portion;

c) an axial guide fixed with respect to said injector body, and having a lateral surface through which said discharge passage comes out; and d) a shutter fitted in substantially fluidtight manner to said lateral surface, so as to slide axially, under the control of said electro-actuator, between a closed position, in which it closes said discharge passage and is subjected to a substantially zero resultant axial force by the pressure of the fuel, and an open position, in which it opens said discharge passage to vary the pressure in said control chamber and so produce axial movement of said control rod;

wherein said tubular portion and said axial guide form part of a single body formed in one piece.

2. An injector as claimed in claim 1, wherein said axial guide is defined by a rod, and said shutter is defined by a sleeve fitted to the outer lateral surface of said rod.

3. An injector as claimed in claim 2, wherein said calibrated portion is so formed as to produce swirl and/or cavitation in the fuel outflow near to the closing area between said shutter and said rod.

4. An injector as claimed in claim 3, wherein said calibrated portion is formed close to the outlet of said discharge passage.

5. An injector as claimed in claim 3, wherein said calibrated portion is formed in said rod.

6. An injector as claimed in claim 5, wherein said calibrated portion extends radially.

7. An injector as claimed in claim 3, wherein said discharge passage terminates with a portion having a cross section larger than that of said calibrated portion.

8. An injector as claimed in claim 1, wherein said single body comprises an intermediate portion bounded axially by said control chamber at the opposite side to said control rod.

9. An injector as claimed in claim 1, wherein said single body comprises an outer flange gripped axially and in fluidtight manner directly against a shoulder of said injector body.

10. An injector as claimed in claim 1, wherein said tubular portion and said injector body define radially between them an annular chamber connecting said control chamber to said inlet; said annular chamber comprising a first annular gap housing a sealing ring interposed between said tubular portion and said injector body, and a second annular gap bounded axially by a shoulder of said single body and smaller radially than said first annular gap.

11. An injector as claimed in claim 10, wherein said first and said second annular gap are defined, on said injector body, by respective cylindrical surfaces connected to each other by a conical surface converging from the first to the second annular gap.

12. A fuel injector for an internal combustion engine; the injector terminating with a nozzle for injecting fuel into a relative cylinder of the engine, and comprising:

a hollow injector body extending in an axial direction;

a control rod movable axially with respect to said injector body to open/close said nozzle;

a control servovalve housed in said injector body and comprising:

a) an electro-actuator;

b) a control chamber, which is bounded axially at one side by said control rod and radially by a tubular portion and communicates with a fuel inlet and with a discharge passage comprising a calibrated portion;

c) an axial guide fixed with respect to said injector body, and having a lateral surface through which said discharge passage comes out; and d) a shutter fitted in substantially fluidtight manner to said lateral surface, so as to slide axially, under the control of said electro-actuator, between a closed position, in which it closes said discharge passage and is subjected to a substantially zero resultant axial force by the pressure of the fuel, and an open position, in which it opens said discharge passage to vary the pressure in said control chamber and so produce axial movement of said control rod;

wherein said tubular portion and said axial guide are coaxial along said axial direction, and wherein said tubular portion and said axial guide form part of a single body formed in one piece.

13. A fuel injector for an internal combustion engine; the injector terminating with a nozzle for injecting fuel into a relative cylinder of the engine, and comprising:

a hollow injector body extending in an axial direction;

a control rod movable axially with respect to said injector body to open/close said nozzle;

a control servovalve housed in said injector body and comprising:

a) an electro-actuator;

b) a control chamber, which is bounded axially at one side by said control rod and radially by a tubular portion and communicates with a fuel inlet and with a discharge passage comprising a calibrated portion;

c) an axial guide fixed with respect to said injector body, and having a lateral surface through which said discharge passage comes out; and d) a shutter fitted in substantially fluidtight manner to said lateral surface, so as to slide axially, under the control of said electro-actuator, between a closed position, in which it closes said discharge passage and is subjected to a substantially zero resultant axial force by the pressure of the fuel, and an open position, in which it opens said discharge passage to vary the pressure in said control chamber and so produce axial movement of said control rod;

an intermediate portion fixed with respect to said injector body, bounding axially said control chamber at the opposite side with respect to said control rod, located axially between said tubular portion and said axial guide, and having part of said discharge passage;

wherein said tubular portion, said intermediate portion and said axial guide are coaxial along said axial direction, and wherein said tubular portion, said intermediate portion and said axial guide form part of a single body formed in one piece.

14. A fuel injector for an internal combustion engine; the injector terminating with a nozzle for injecting fuel into a relative cylinder of the engine, and comprising:

a hollow injector body extending in an axial direction;

a control rod movable axially with respect to said injector body to open/close said nozzle;

a control servovalve housed in said injector body and comprising:

a) an electro-actuator;

b) a control chamber, which is bounded axially at one side by said control rod and radially by a tubular portion and communicates with a fuel inlet and with a discharge passage comprising a calibrated portion;

c) an axial guide fixed with respect to said injector body, and having a lateral surface through which said discharge passage comes out; and d) a shutter fitted in substantially fluidtight manner to said lateral surface, so as to slide axially, under the control of said electro-actuator, between a closed position, in which it closes said discharge passage and is subjected to a substantially zero resultant axial force by the pressure of the fuel, and an open position, in which it opens said discharge passage to vary the pressure in said control chamber and so produce axial movement of said control rod;

an intermediate portion fixed with respect to said injector body, bounding axially said control chamber at the opposite side with respect to said control rod, located axially between said tubular portion and said axial guide, and having part of said discharge passage;

wherein said tubular portion, said intermediate portion and said axial guide are coaxial along said axial direction, wherein said intermediate portion terminates with an outer flange; and wherein said tubular portion, said intermediate portion, said flange and said axial guide form part of a single body formed in one piece.

* * * * *